US009123298B2

(12) United States Patent
Kim et al.

(10) Patent No.: US 9,123,298 B2
(45) Date of Patent: Sep. 1, 2015

(54) LED DRIVING APPARATUS, METHOD FOR DRIVING LED, AND DISPLAY APPARATUS THEREOF

(75) Inventors: Tae-sung Kim, Suwon-si (KR); Jeong-il Kang, Yongin-si (KR); Young-soo Kim, Hwaseong-si (KR); Gil-yong Chang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 463 days.

(21) Appl. No.: 13/617,278

(22) Filed: Sep. 14, 2012

(65) Prior Publication Data

US 2013/0099690 A1 Apr. 25, 2013

(30) Foreign Application Priority Data

Oct. 19, 2011 (KR) ..... 10-2011-0107224

(51) Int. Cl.
*H05B 37/02* (2006.01)
*G09G 3/34* (2006.01)
*H05B 33/08* (2006.01)

(52) U.S. Cl.
CPC ..... *G09G 3/3406* (2013.01); *H05B 33/0815* (2013.01); *H05B 33/0848* (2013.01)

(58) Field of Classification Search
CPC .. H05B 33/08; H05B 33/089; H05B 33/0812; H05B 33/0815; H05B 33/0821; H05B 33/0845; H05B 33/0848; H05B 33/0851; H05B 33/0887
USPC ..... 315/210, 217, 291, 294, 287, 297, 315/302–304, 307
See application file for complete search history.

(56) References Cited

U.S. PATENT DOCUMENTS

| | | | | |
|---|---|---|---|---|
| 7,898,187 | B1 * | 3/2011 | Mei et al. | 315/247 |
| 8,525,442 | B2 * | 9/2013 | Zimmermann et al. | 315/307 |
| 8,664,883 | B2 * | 3/2014 | Hiramatu et al. | 315/291 |
| 2006/0022607 | A1 | 2/2006 | Hsu | |
| 2010/0052569 | A1 | 3/2010 | Hoogzaad et al. | |
| 2010/0308733 | A1 | 12/2010 | Shao | |
| 2011/0109247 | A1 | 5/2011 | Hoogzaad et al. | |
| 2013/0141017 | A1 * | 6/2013 | Esaki et al. | 315/307 |

FOREIGN PATENT DOCUMENTS

KR 10-2011-0029069 A 3/2011

OTHER PUBLICATIONS

Communication issued Jun. 20, 2012 by the European Patent Office in counterpart European Application No. 12162262.5.
Anonymous, "PT4115", Powtech, Jun. 2, 2010, pp. 1-18, XP002677227.
Dodd Alan et al. "Hysteretic Converters in High Brightness LED Control", Feb. 15, 2008, pp. 1-12, XP002653341.

* cited by examiner

*Primary Examiner* — Douglas W Owens
*Assistant Examiner* — James H Cho
(74) *Attorney, Agent, or Firm* — Sughrue Mion, PLLC

(57) ABSTRACT

A display apparatus is provided. The display apparatus includes a display panel which displays an image, a LED module which provides backlight to the display panel, a LED driving unit which selectively uses current of an inductor to apply driving voltage to the LED module, a sensing unit which senses a current value of the inductor, and a switching control unit which adjusts the driving voltage according to sensing result by the sensing unit.

16 Claims, 9 Drawing Sheets

LED DRIVING APPARATUS, METHOD FOR DRIVING LED, AND DISPLAY APPARATUS THEREOF

CROSS-REFERENCE TO RELATED APPLICATIONS

This application claims priority from Korean Patent Application No. 2011-0107224, filed in the Korean Intellectual Property Office on Oct. 19, 2011, the disclosure of which is incorporated herein by reference.

BACKGROUND

1. Field

Methods and apparatuses consistent with the exemplary embodiments relate to a Light Emitting Diode (LED) driving apparatus, a method for driving a LED, and a display apparatus thereof, and more particularly, to a LED driving apparatus providing backlight to a display which cannot emit light by itself, a method for driving a LED, and a display apparatus thereof.

2. Description of the Related Art

A LED has been widely used in various fields thanks to its excellent performance and longevity, and it is provided even as backlight of a display apparatus.

Meanwhile, there are various types of driving circuits to control driving of a LED to utilize it as backlight of a display apparatus. Some of the LED driving circuits which have been used widely include a boost type and a buck type.

In the case of a boost type, as a switching transistor is connected to ground, its operation is relatively easy. In addition, a transistor connected to ground may be further added and thus, high-resolution dimming can be simply realized. However, a boost type requires a considerable amount of input electric current, increasing overall system costs.

Meanwhile, in the case of a buck type, the costs involving a LED driving circuit may be reduced by applying a peak current control method without feedback if high-resolution dimming is not required. However, such method may have problems in that the average value of output current may be fluctuated to a great extent in accordance with changes of load or conditions of input and output.

Therefore, a method for realizing a LED driving circuit which may reduce the costs involving a LED driving circuit without significant changes in the average value of output current with respect to changes of load or conditions of input and output are required.

SUMMARY

Aspects of the exemplary embodiments relate to a LED driving apparatus which may display an image by providing consistent current to a LED module regardless of the characteristics of parts of the apparatus and changes in input/output voltage while reducing the costs of a LED driving circuit, a method for driving a LED, and a display apparatus thereof.

A display apparatus, according to an exemplary embodiment, includes a display panel which displays an image, a LED module which provides backlight to the display panel, a LED driving unit which selectively uses current of an inductor to apply a driving voltage to the LED module, a sensing unit which senses a current value of the inductor, and a switching control unit which adjusts the driving voltage according to a sensing result by the sensing unit.

The LED driving unit may apply a driving voltage to the LED module while exciting the inductor using current input from an external power source or the LED driving unit may apply a driving voltage to the LED module using current induced by the excited inductor.

The LED driving unit may include a transistor connected to the inductor, and the switching control unit may turn on or off the transistor according to a sensing result by the sensing unit, apply a driving voltage to the LED module while exciting the inductor using current input from an external power source if the transistor is turned on, and apply driving voltage to the LED module using current induced by the excited inductor if the transistor is turned off.

The switching control unit may turn on the transistor if the current value sensed by the sensing unit is a predetermined first reference value, and turn off the transistor if the current value sensed by the sensing unit is a predetermined second reference value. The second reference value may be greater than the first reference value.

The LED driving unit may include an input terminal which receives the external power source, a first capacitor which connects the input terminal to ground, a first diode which connects one end of the inductor to the input terminal, and a second capacitor which connects the other end of the inductor to the input terminal, and the LED module may be connected to the second capacitor in parallel and a connection node between the inductor and the diode may be connected to one end of the transistor.

The sensing unit may include a first comparator which compares the current value of the inductor with the first reference value and a first AND gate which performs a logic product of an inversion gate signal regarding a gate signal applied to a gate of the transistor and comparison result of the first comparator and outputs the result.

A LED driving apparatus which controls a LED module according to an exemplary embodiment, includes a LED driving unit which selectively uses current of an inductor to apply a driving voltage to the LED module, a sensing unit which senses a current value of the inductor, and a switching control unit which adjusts the driving voltage according to a sensing result of the sensing unit.

The LED driving unit may apply a driving voltage to the LED module while exciting the inductor using current input from an external power source or the LED driving unit may apply a driving voltage to the LED module using current induced by the excited inductor.

The LED driving unit may include a transistor connected to the inductor, and the switching control unit may turn on or off the transistor according to a sensing result by the sensing unit, apply a driving voltage to the LED module while exciting the inductor using current input from an external power source if the transistor is turned on, and apply a driving voltage to the LED module using current induced by the excited inductor if the transistor is turned off.

The switching control unit may turn on the transistor if the current value sensed by the sensing unit is a predetermined first reference value and turn off the transistor if the current value sensed by the sensing unit is a predetermined second reference value. The second reference value may be greater that the first reference value.

The LED driving unit may include an input terminal which receives the input voltage, a first diode which connects one end of the inductor to the input terminal, and a capacitor which connects the other end of the inductor to the input terminal, and the LED module is connected to the capacitor in parallel and a connection node between the inductor and the diode is connected to one end of the transistor.

The sensing unit may include a first comparator which compares the current value of the inductor with the first reference value and a first AND gate which performs a logic product of an inversion signal regarding a gate signal applied to a gate of the transistor and comparison result of the first comparator and outputs the result.

A LED driving method to control a LED module according to an exemplary embodiment, includes sensing a current value of an inductor connected to the LED module and applying a driving voltage to the LED module using an external power source or the inductor excited by the external power source according to the sensing result.

The applying of the driving voltage to the LED module may include applying driving voltage to the LED module while exciting the inductor using current input from the external power source or applying the driving voltage to the LED module using current induced by the excited inductor.

The sensing may include sensing whether the current value of the inductor is a first reference value or a second reference value, and the second reference value may be greater than the first reference value.

The inductor may be connected to a transistor, and the applying the driving voltage to the LED module may include turning on or off the transistor according to the sensing result by the sensing unit, applying the driving voltage to the LED module by turning on the transistor while exciting the inductor using current input from an external power source if the current value of the inductor is a first reference value, and applying the driving voltage to the LED module by turning off the transistor using current induced by the excited inductor if a value of current of the inductor is a second reference value.

According to various exemplary embodiments, a transistor of a LED driving circuit is not turned on regularly. Instead, the transistor may be turned on if current of an inductor, that is, current of a LED module reaches a predetermined value (such as, 0[A]).

Accordingly, constant current may flow in the LED module regardless of input/output voltage and characteristics of parts of the apparatus. In addition, as current of the LED module is determined based on a voltage of one end of an inductor without feedback of current of the LED module, the LED driving circuit may be realized with lower costs

BRIEF DESCRIPTION OF THE DRAWINGS

These and/or other aspects will become apparent and more readily appreciated from the following description of the exemplary embodiments, taken in conjunction with the accompanying drawings, of which.

DETAILED DESCRIPTION OF THE EXEMPLARY EMBODIMENTS

Figure 1:
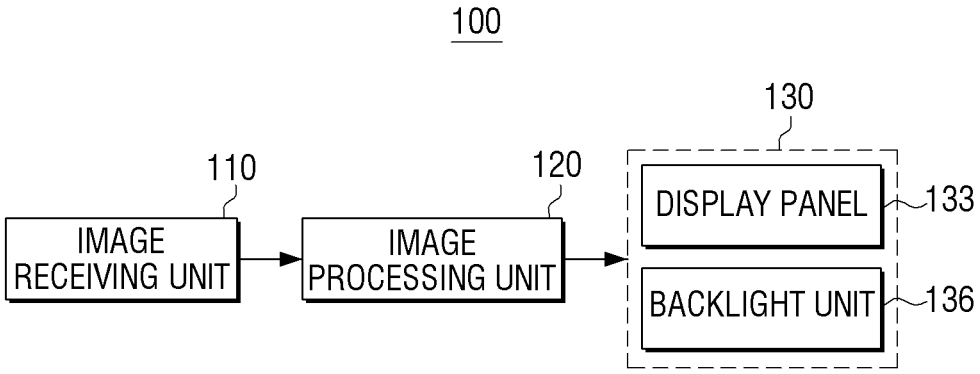
FIG. 1 is a block diagram to explain configuration of a display apparatus according to an exemplary embodiment.

Reference will now be made in detail to the exemplary embodiments, examples of which are illustrated in the accompanying drawings, wherein like reference numerals refer to like elements throughout. The exemplary embodiments are described below, in order to explain the exemplary embodiments by referring to the figures.

FIG. 1 is a block diagram to explain configuration of a display apparatus 100 according to an exemplary embodiment. As illustrated in FIG. 1, the display apparatus 100 includes an image receiving unit 110, an image processing unit 120 and a display unit 130.

The image receiving unit 110 receives an image signal and image data from a broadcasting company, a satellite, or an external input device via cable or wirelessly. For example, the image receiving unit 110 may be a tuner to receive a broadcast signal or an A/V interface to receive an image from an external image device.

The image processing unit 120 performs signal-processing such as video decoding, video scaling, frame rate conversion (FRC), brightness adjustment, color adjustment, etc. with respect to an image output from the image receiving unit 110.

The display unit 130 displays an input image on a screen. As illustrated in FIG. 1, the display unit 130 includes a display panel 133 and a backlight unit 136.

The display panel 133 displays an image signal-processed by the image processing unit 130. Herein, the display panel 133 may be a Liquid Crystal Display (LCD), but it may also be other panels using backlight.

The backlight unit irradiates backlight to the display panel 133. As the display panel 133 cannot emit light by itself, the backlight unit 136 irradiates white light to the display panel 133 as backlight.

The backlight unit 136 includes a plurality of light sources. Herein, a Light Emitting Diode (LED) may be used as a plurality of light sources. In other words, a plurality of light sources may be a LED module in which at least one LED is connected on a Printed Circuit Board (PCB).

Meanwhile, the backlight unit 136 may be edge-type backlight. Specifically, the backlight unit 136 may have an edge type where light sources are disposed at an edge area of the display panel 133. However, this is only an example, and the backlight unit 136 may have a direct type where light sources are disposed evenly on the back of the display panel 133.

Figure 2:
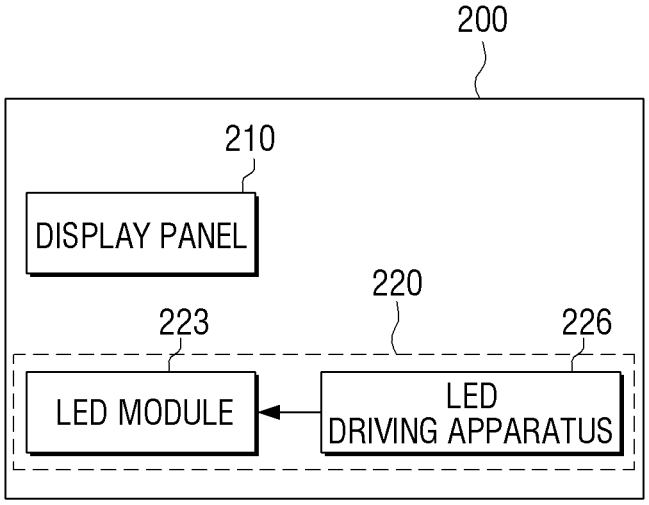
FIG. 2 is a block diagram illustrating a specific configuration of a display unit according to an exemplary embodiment.

FIG. 2 is a block diagram illustrating a specific configuration of a display unit according to an exemplary embodiment. As illustrated in FIG. 2, a display unit 200 includes a display panel 210 and a backlight unit 220. Meanwhile, the display panel 210 and the backlight unit 220 illustrated in FIG. 2 performs the same functions as the display panel 133 and the backlight unit 136 and thus, further description will not be provided.

The backlight unit 220 includes a LED module 223 and a LED driving apparatus 226.

The LED module 223 irradiates backlight to the display panel 210. Specifically, the LED module 223 has at least one LED connected to a PCB and may irradiate backlight to the display panel 210 according to driving voltage applied from the driving apparatus 226. Herein, the brightness of the LED module 223 may be determined according to the average value of current of the LED module 223.

The LED driving apparatus 226 provides power to the LED module 223.

Specifically, the LED driving apparatus 226 may provide energy stored in an external power or the LED driving apparatus 226 to the LED module 223 based on a dimming signal (PWMD) for driving the LED module 223 and current of the LED module 223. Herein, the dimming signal may represent a signal to adjust the brightness and color temperature of a LED or to compensate the temperature of a LED using the duty ratio of a PWM signal.

More specifically, if the current output from the LED module 223 reaches a predetermined peak value while a dimming signal is turned on, the LED driving apparatus 226 may cut off external power supplied to the LED module 223 and provide driving power to the LED module 223 based on energy stored in the LED driving apparatus 226. If the current output from the LED module 223 is a predetermined value while a dimming signal is turned on, the LED driving apparatus 226 may control to supply external power to the LED module 223 again. In this case, the LED driving apparatus 226 may store energy therein through external power.

Meanwhile, the LED driving apparatus 226 according to an exemplary embodiment includes a buck-type LED driving circuit and may control LED output current according to a peak current control method.

Herein, the buck-type LED driving circuit refers to a driving circuit which is realized as elements like a transistor, an inductor, a capacitor, and a diode, converts external driving voltage and provides the converted DC voltage to a connected LED module.

Specifically, if a transistor is turned on while a dimming signal is turned on, the buck-type LED driving circuit converts external power to driving voltage of a LED module and provides it to the LED module. In addition, if the current of a transistor reaches a predetermined peak value according to peak current control, the LED driving circuit may turn off a transistor and provide energy stored in an inductor and a capacitor to the LED module during the on-time of the transistor.

Using the above method, the buck-type LED driving circuit controls to let constant current flow in the LED module.

Meanwhile, the prior art buck-type LED driving circuit controls the on-time of a transistor using a clock signal with a predetermined frequency. That is, the prior art buck-type LED driving circuit turns on a transistor periodically according to a clock signal so that an external driving power supplies driving voltage to a LED module.

Meanwhile, the LED driving apparatus 226 according to an exemplary embodiment does not turn on a transistor periodically according to a clock signal and instead, turns on a transistor when a LED output current reaches a predetermined value, so that an external driving power supplies driving voltage to a LED module. Hereinafter, a LED driving apparatus according to an exemplary embodiment will be explained in greater detail with reference to FIG. 3.

Figure 3:
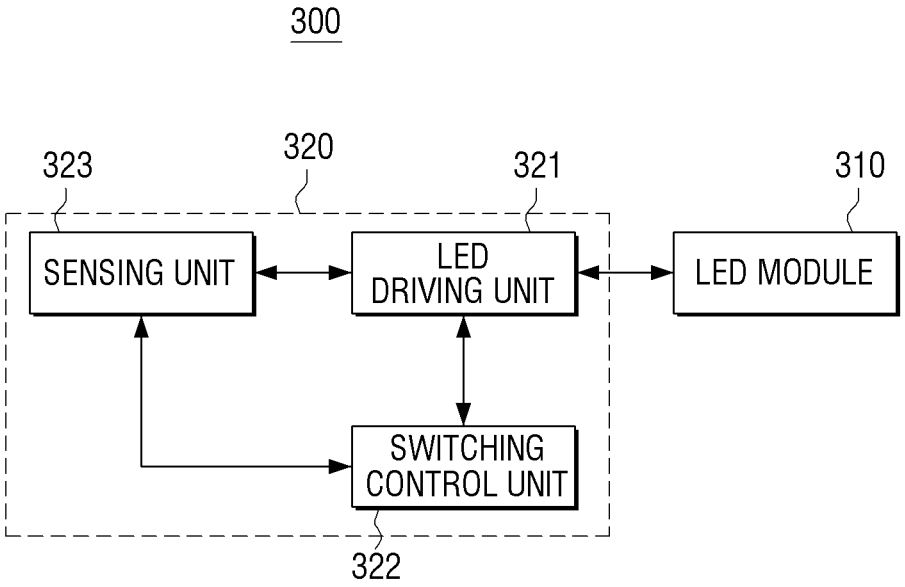
FIG. 3 is a block diagram illustrating a specific configuration of a LED driving control unit according to an exemplary embodiment.

FIG. 3 is a block diagram illustrating a specific configuration of a LED driving apparatus according to an exemplary embodiment. As illustrated in FIG. 3, a LED driving apparatus 320 includes a LED driving unit 321, a switching control unit 322, and a sensing unit 323. For convenience of explanation, a LED module 310 constituting a backlight unit 300 is also illustrated.

The LED driving unit 321 uses current of an inductor selectively to apply driving voltage to a LED module.

Specifically, the LED driving unit 321 may apply driving voltage to the LED module 310 while exciting an inductor using current input from an external power or apply driving voltage to the LED module 310 using current induced by an excited inductor. That is, the LED driving unit 321 includes inductor and a transistor connected to an inductor, supplies external voltage to the LED module 310 and the inductor if the transistor is turned on, and supplies driving voltage to the LED module 310 using energy stored in the inductor if the transistor is turned off.

The switching control unit 322 adjusts the driving voltage according to a sensing result of the sensing unit 323. That is, the switching control unit 322 controls a switching operation of a transistor in the LED driving unit 321 based on a dimming signal for driving the LED module 310 and current of the LED module 310.

Specifically, the switching control unit 322 turns on or off a transistor according to a sensing result of the sensing unit 323, applies driving voltage to the LED module 310 while exciting an inductor using current input from external power if the transistor is turned on, and applies driving a voltage to the LED module 310 using current induced by the excited inductor if the transistor is turned off.

More specifically, if current sensed by the sensing unit 323 is a predetermined first reference value, the switching control unit 322 may turn on a transistor, and if current sensed by the sensing unit 323 is a predetermined second reference value, the switching control unit 322 may turn off a transistor. Herein, the second reference value may be a current value which is double the average value of current of the LED module 310, and the first reference value may be 0[A]. That is, the second reference value may be greater than the first reference value.

The sensing unit 323 senses a current value of an inductor.

Specifically, the sensing unit 323 may determine whether current of an inductor reaches a predetermined first reference value by comparing the voltage of one end of the inductor with the predetermined voltage. Herein, the first reference value may be 0[A].

That is, if the voltage of one end of an inductor is 0[A], the sensing unit 320 determines that the current of the inductor is 0[A] and accordingly, the sensing unit 320 may apply external power to the LED module 310 by transferring a control signal to turn on a transistor to the switching control unit 322.

In other words, according to an exemplary embodiment, a transistor of a LED driving circuit is not turned on regularly. Instead, the transistor may be turned on if current of an inductor, that is, current of a LED module reaches a predetermined value (such as, 0[A]).

Accordingly, constant current may flow in the LED module regardless of input/output voltage and characteristics of parts of the apparatus. In addition, as current of the LED module is determined based on voltage of one end of an inductor without feedback of current of the LED module, the LED driving circuit may be realized with lower costs.

In addition, the sensing unit 323 detects a voltage value applied to a resistance connected to a source terminal of a transistor and transfers it to the switching control unit 322. That is, the sensing unit 323 detects a voltage value applied to a resistance connected to a source terminal of a transistor to determine whether current of an inductor reaches a second reference value, and transfers it to the switching control unit 322. Accordingly, the switching control unit 322 may turn off the transistor if the transferred voltage value of the resistance connected to the source terminal of the transistor reaches the second reference value. Herein, the second reference value may be a current value which is double the average of current of the LED module 310.

Figure 4:
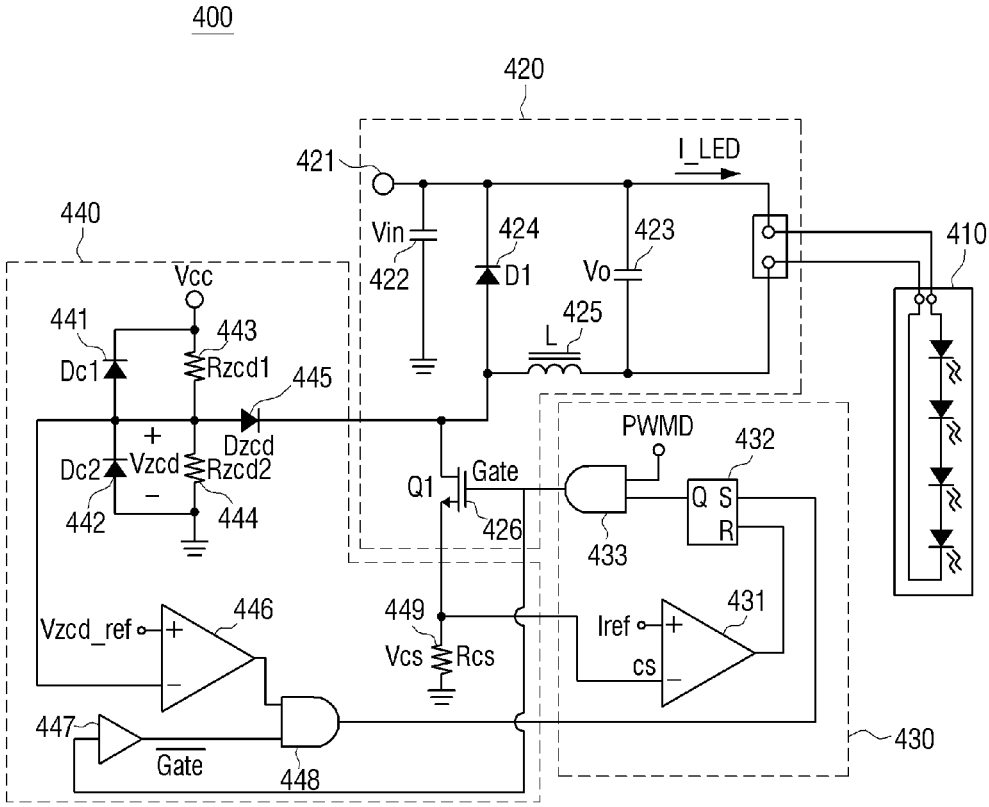
FIG. 4 is a circuit diagram illustrating a specific configuration of a LED driving control unit according to an exemplary embodiment.

FIG. 4 is a circuit diagram to explain a specific configuration of a LED driving control unit according to an exemplary embodiment. That is, FIG. 4 illustrates a specific configuration of the LED driving control unit illustrated in FIG. 3.

A LED driving unit 420 includes an input terminal 421 receiving external power, a first capacitor 422 connecting the input terminal 421 to ground, a first diode 424 connecting one end of an inductor 425 to the input terminal 421, and a second capacitor 423 connecting the other end of the inductor 425 to the input terminal 421.

Herein, the LED module 410 may be connected to the second capacitor in parallel, and a connection node between the inductor 425 and the diode 424 may be connected to one end of a transistor 426.

Meanwhile, specific configuration of the LED driving unit 420 is as below.

The LED driving unit 420 includes the input unit 421, the first capacitor 422, the second capacitor 423, the first diode 424, the inductor 425, and the transistor 426.

The input unit 421 receives external power. Specifically, the input unit 421 is commonly connected to one end of the first capacitor 422, one end of the second capacitor 423, a cathode of the first diode 424, and an anode of the LED module 410.

The first capacitor 422 is connected to the input terminal 421 in parallel. Specifically, one end of the first capacitor 422 is commonly connected to the input unit 421, one end of the second capacitor 423, a cathode of the first diode ($D_1$, 424), and an anode of the LED module 410, and the other end of the first capacitor 422 is connected to ground.

Accordingly, the first capacitor 422 may store an external driving power ($V_i$) input from the input unit 421 and provide it to the LED module 410. However, this is only exemplary, and the input unit 421 and the first capacitor 422 may be replaced with an external driving voltage power ($V_i$).

The second capacitor 423 is connected to the LED module 410 in parallel. Specifically, one end of the second capacitor 423 is commonly connected to the input unit 421, one end of the first capacitor 422, a cathode of the first diode 424, and an anode of the LED module 410, and the other end of the second capacitor 423 is commonly connected to a cathode of the LED module 410 and one end of the inductor 425.

The cathode of the first diode 424 is commonly connected to the input unit 421, one end of the first capacitor 422, one end of the second capacitor 423, and an anode of the LED module 421, and the anode is commonly connected to the other end of the inductor 425 and a drain of the transistor 426.

One end of the inductor 425 is commonly connected to a cathode of the LED module 410 and the other end of the second capacitor 423, and the other end of the inductor 425 is commonly connected to an anode of the first diode 424 and a drain of the transistor 426.

On/off operation of the transistor 426 is controlled by the switching control unit 430. Specifically, the drain of the transistor 426 is commonly connected to one end of the inductor 425 and an anode of the diode 424, the gate is connected to the switching control unit 430, and the source is connected to the sensing unit 440.

The switching control unit 430 controls a switching operation of the transistor 426 based on a dimming signal for driving the LED module 410 and current of the LED module 410.

Specifically, if the dimming signal and the control signal of the sensing unit 440 are turned on, the switching control unit 430 turns on the transistor 426 to apply external power ($V_i$) to the LED module 410. If current of the inductor 425 is the second reference value, the switching control unit 430 turns off the transistor 426 to drive the LED module 410 based on energy stored in the inductor 425 during on-time of the transistor. The switching control unit 430 may include a second comparator 431, an RS flip flop 432, and a second AND gate 433.

The second comparator 431 compares the current value of the inductor 425 with the second reference value. That is, the second comparator 431 may determine whether current of the inductor 425 reaches the second reference value ($I_{ref}$) using the voltage ($V_{cs}$) applied to a first resistance 449 according to current of the inductor 425 during on-time of the transistor 426. Herein, the second reference value ($I_{ref}$) may be set by a user, and the average value of current of the LED module 410 may be determined according to the second reference value ($I_{ref}$) and the brightness of the LED module 410 may also be determined accordingly.

The RS flip flop 432 receives the comparison result of the second comparator 431 as a reset signal and receives a control signal of the sensing unit 440 as a set signal. Specifically, if a control signal output from the sensing unit 440 is high (or on), the RS flip flop 432 may output a high signal and if a high signal is input from the second comparator 431, the RS flip flop 432 may output a low signal.

The second AND gate 433 outputs a logic product of an output signal of the RS flip flop 432 and a dimming signal to a gate of the transistor 426. That is, if a high signal is input from the RS flip flop 432 while a dimming signal is high signal, the second AND gate 433 outputs a high signal to a gate of the transistor 426.

The sensing unit 440 compares the voltage of one end of the inductor 425 with a predetermined value of voltage ($V_{zcd_ref}$) and determines whether current of the inductor 425 is the first reference value. If it is determined that current of the inductor 425 reaches the first reference value, the sensing unit 440 outputs a control signal to turn on the transistor 426 to the switching control unit 430. To do so, the sensing unit 440 may include a first comparator 446 which compares the current value of the inductor 425 with the first reference value and a first AND gate 448 which performs a logic product of a conversion gate signal regarding a gate signal applied to the gate of the transistor 426 and the comparison result of the first comparator 446 and outputs the result.

Meanwhile, the specific circuit configuration of the sensing unit 440 is as follows.

The sensing unit 440 may include a second diode 441, a third diode 442, a second resistance 443, a third resistance 444, a fourth diode 445, a first comparator 446, an inverter 447, the first AND gate 448 and a first resistance 449.

The cathode of the second diode 441 is connected to a predetermined voltage source ($V_{cc}$). Specifically, the cathode of the second diode 441 is commonly connected to a predetermined voltage source ($V_{cc}$) and one end of the second resistance 443, the anode is commonly connected to the other end of the second resistance 443, the anode of the fourth diode 445, one end of the third resistance 444, the cathode of the third diode 442, and the inversion terminal of the first comparator 446.

The cathode of the third diode 442 is connected to the anode of the second diode ($D_{cl}$, 441) and the anode of the third diode 442 is connected to ground. Specifically, the cathode of the third diode 442 is commonly connected to the anode of the second diode 441, the other end of the second resistance 443, the anode of the fourth diode 445, one end of the third resistance 444, and the inversion terminal of the first comparator 446, and the anode is commonly connected to the other end of the third resistance 444 and ground.

Herein, the second diode 441 and the third diode 442 may be a clamp diode to prevent an excess voltage rating applied to the inversion terminal of the first comparator 446.

The second resistance 443 is connected to the second diode 441 in parallel. Specifically, one end of the second resistance 443 is commonly connected to a predetermined voltage source ($V_{cc}$) and the cathode of the second diode 441, and the other end of the second resistance 443 is commonly connected to the anode of the second diode 441, the cathode of the third diode 442, the anode of the fourth diode 445, one end of the third resistance 444, and the inversion terminal of the first comparator 446.

The third resistance 444 is connected to the third diode 442 in parallel. Specifically, one end of the third resistance 444 is commonly connected to the anode of the second diode 441, the cathode of the third diode 442, the other end of the second resistance 443, the anode of the fourth diode 445, and the inversion terminal of the first comparator 446, and the other end of the third resistance 444 is connected to the anode of the third diode 442 and ground.

Herein, if the transistor 426 is turned off, the third resistance 444 may provide the first comparator 446 with voltage for determining whether current of the inductor 425 is the first reference value.

The cathode of the fourth diode 445 is connected to the drain of the transistor 426, and the anode of the fourth diode 445 is commonly connected to the anode of the second diode 441 and the cathode of the third diode 442. Specifically, the cathode of the fourth diode 445 is connected to the drain of the transistor 426, and the anode of the fourth diode 445 is commonly connected to the anode of the second diode 441, the cathode of the third diode 442, the other end of the second resistance 443, one end of the third resistance 444, and the inversion terminal of the first comparator 446.

Herein, the fourth diode 445 protects the first comparator 446 from voltage applied to the drain of the transistor 426 when the transistor 426 is turned off. Therefore, resistance may be added to the fourth diode 445 in series, and the first comparator 446 may be protected using a high-voltage capacitor instead of a diode.

The first comparator 446 compares voltage applied to the third resistance 444 with a predetermined value of voltage ($V_{zcd_ref}$) to determine whether current of the LED module 410 is the first reference value, that is, 0[A] when the transistor 426 is turned off. The predetermined value of voltage ($V_{zcd_ref}$) may be 0[V].

Specifically, the inversion terminal of the first comparator 446 is commonly connected to the other end of the second resistance 443, one end of the third resistance 444, the anode of the second diode 441, the cathode of the third diode 442, and the anode of the fourth diode 445, and non-inversion terminal is connected to predetermined volume of voltage ($V_{zcd_ref}$).

The inverter 447 inverts and outputs a gate signal applied to the gate of the transistor 426. Specifically, if the inverter 447 receives a gate signal applied to the gate of the transistor 426, the inverter 447 inverts the input gate signal and outputs it to the first AND gate 448.

The first AND gate 448 outputs a logic product of the inverted gate signal and an output signal of the first comparator 446 as a control signal regarding the switching control unit 430. Specifically, if a high signal is input from the first comparator 446 while the inverted gate signal is a high signal, the first AND gate 448 outputs a high signal as a set input of the RS flip flop 432.

One end of the first resistance 449 is connected to the source of the transistor 426 and the other end of the first resistance 449 is connected to ground. Herein, the first resistance 449 may provide the switching control unit 430 with voltage ($V_{cs}$) for determining whether current of the inductor 425 is the second reference value while the transistor is turned on.

Meanwhile, a specific operation of the above-mentioned LED driving apparatus will be explained in detail with reference to FIGS. 5A and 5B.

Figure 5A:
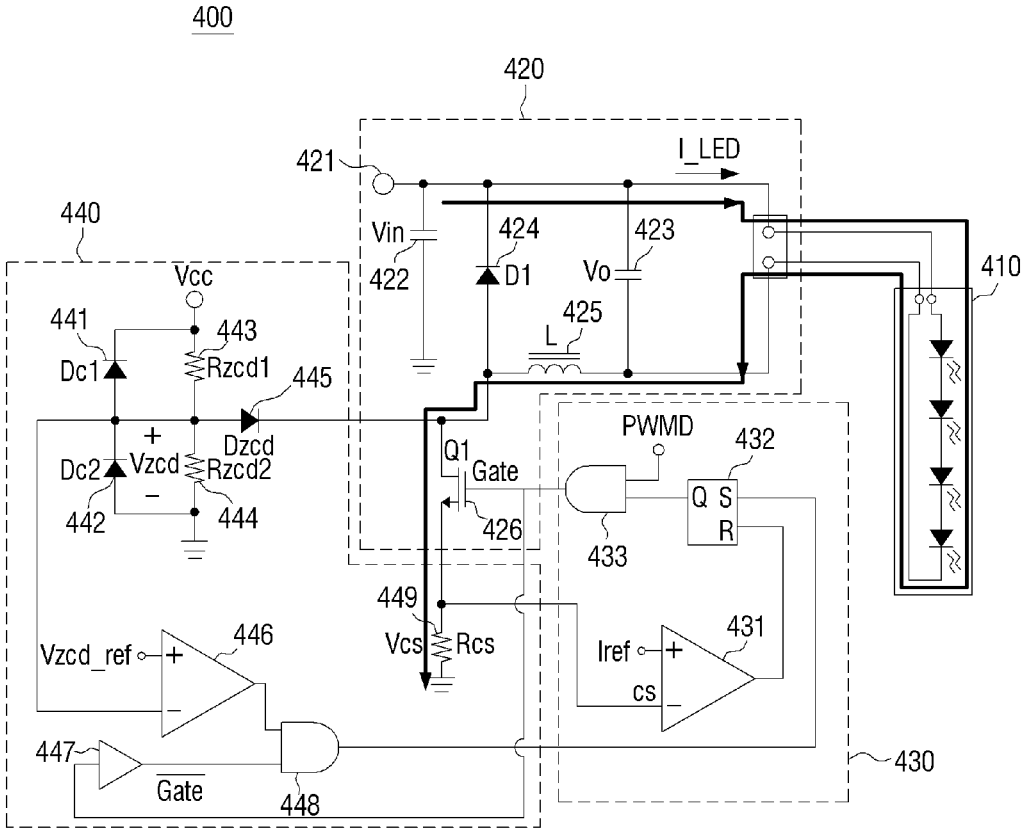
FIGS. 5A and 5B are circuit diagrams illustrating a specific operation of a LED driving control unit according to an exemplary embodiment.
Figure 5B:
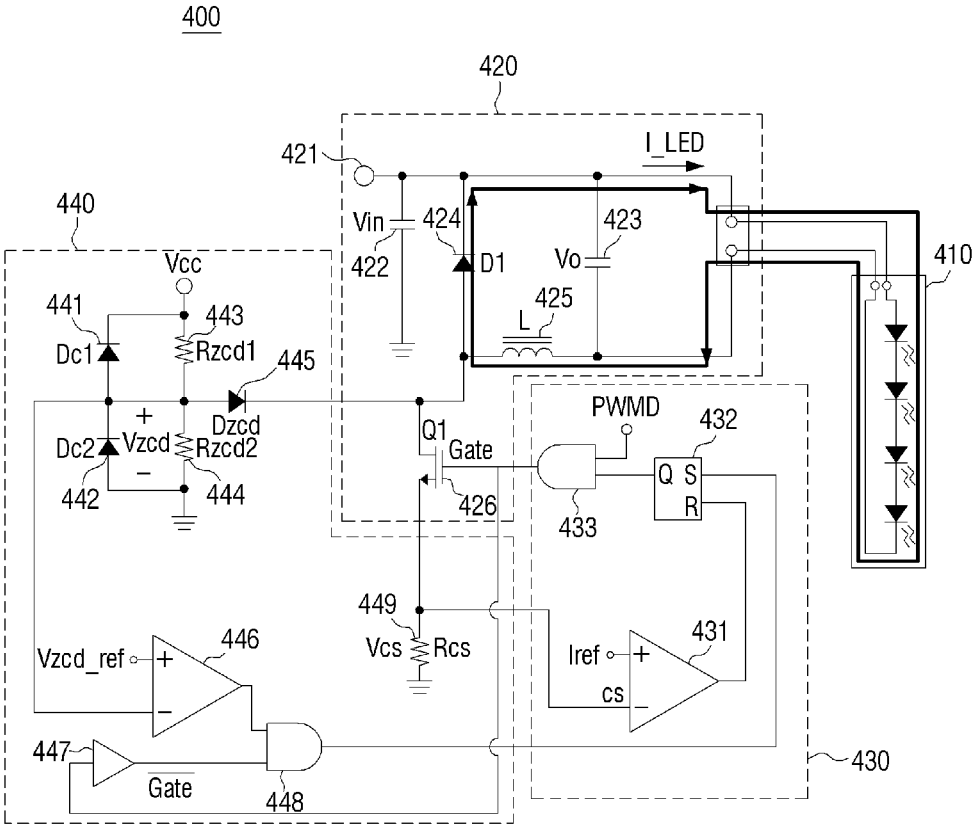

FIGS. 5A and 5B are circuit diagrams to explain a specific operation of a LED driving control unit according to an exemplary embodiment. Specifically, FIGS. 5A and 5B illustrate the cases where the transistor 426 is turned on/off, respectively.

If the transistor 426 is turned on under the control of the switching control unit 430 while a dimming signal is turned on, external power ($V_i$) input from the input terminal 421 is provided to the LED module 410. Accordingly, current (hereinafter, referred to as 'LED output electric current') flows in the LED module 410 in the direction of arrow illustrated in FIG. 5A.

Herein, variation (that is, a gradient) of LED output current over time becomes $(V_i-V_o)/L$ (L is inductance of the inductor 425) based on external power ($V_i$) input from the input terminal 421 and output voltage ($V_o$) of the second capacitor 423. That is, the LED output current has the gradient of $(V_i-V_o)/L$ and increases gradually.

Subsequently, if the LED output current reaches the second reference value ($I_{ref}$), the switching control unit 430 turns off the transistor 426.

Specifically, the second comparator 431 determines whether the LED output current reaches the second reference value ($I_{ref}$), and if the LED output current reaches the second reference value ($I_{ref}$), the second comparator 431 outputs a high signal through a reset input of the RS flip flop 432.

Accordingly, the RS flip flop 432 outputs a low signal to the second AND gate 433 and the second AND gate 433 which receives the low signal while a dimming signal is turned on outputs the low signal to the gate of the transistor 426. Therefore, the transistor 426 is turned off when the LED output current reaches the second reference value ($I_{ref}$).

Herein, the second comparator 431 may determine whether the LED output current reaches the second reference value ($I_{ref}$) by sensing voltage ($V_{cs}$) applied to the first resistance 449 (that is, the source voltage of the transistor 426) during on-time of the transistor 426. The second reference value ($I_{ref}$) may be set by a user, and the average value of current of the LED module 410 is determined according to the second reference value ($I_{ref}$) and the brightness of the LED module 410 is determined as a result.

Meanwhile, if the transistor 426 is turned off, the LED module 410 is driven according to energy stored in the inductor 425 during on-time of the transistor, and the LED output current is determined according to the output voltage ($V_o$) of the second capacitor 423. The LED output current flows in the direction of the arrow illustrated in FIG. 5B.

Specifically, if the forward direction of the first diode 424 (that is, turn-on voltage) is ignored, the variation of the LED output current over time becomes $-(V_o)/L$. In other words, the LED output current has the gradient of $-(V_o)/L$ at a predetermined peak value and decreases gradually.

Meanwhile, if the decreasing LED output current reaches '0[A]', a resonance circuit is formed between the parasitic capacitor of the transistor 426 and the inductor 425. Accordingly, the drain voltage of the transistor 426 (voltage of one end of an inductor) decreases in the form of a sine wave, and the voltage applied to the third resistance 444 also decreases in the form of a sine wave.

Subsequently, the first comparator 446 compares voltage ($V_{zcd}$) applied to the third resistance 444 with a predetermined voltage ($V_{zcd_ref}$), and if the voltage ($V_{zcd}$) applied to the third resistance 444 reaches the predetermined voltage ($V_{zcd_ref}$), the first comparator 446 outputs a high signal to the first gate 448.

Herein, the predetermined voltage ($V_{zcd_ref}$) may be 0[V]. That is, the first comparator 446 determines whether the voltage ($V_{zcd}$) applied to the third resistance 444 reaches 0[V] and thus, may determine whether the decreasing LED output current (that is, current of the inductor 425) with the gradient of $-(V_o)/L$ becomes 0[A].

Meanwhile, the first AND gate 448 outputs the logic product of the output signal of the inverter 447 and the output signal of the first comparator 446 as a set input of the RS flip flop 433. Herein, the output signal of the inverter 447 may be an inversion signal of the signal applied to the gate of the transistor 426.

That is, if a high signal is received from the first comparator 446 while an inverted gate signal is a high signal, the first AND gate 448 outputs a high signal as a set input of the RS flip flop 433.

Meanwhile, if a high signal is input as a set input, the RS flip flop 432 outputs a high signal to the second AND gate 433, and if a high signal is input from the RS flip flop 432 while a dimming signal is turned on, the second AND gate 433 outputs a high signal to the gate of the transistor 426. Accordingly, the transistor 426 is turned on again.

In other words, according to an exemplary embodiment, the transistor of a LED driving circuit is not turned on regularly. Instead, the transistor may be turned on when current of an inductor, that is, current of a LED module reaches a predetermined value (for example, 0[A]).

Accordingly, constant current may flow in the LED module regardless of input/output voltage and characteristics of parts of the apparatus. In addition, as current of the LED module is determined based on voltage of one end of an inductor without feedback of current of the LED module, the LED driving circuit may be realized with lower costs.

Figure 6A:
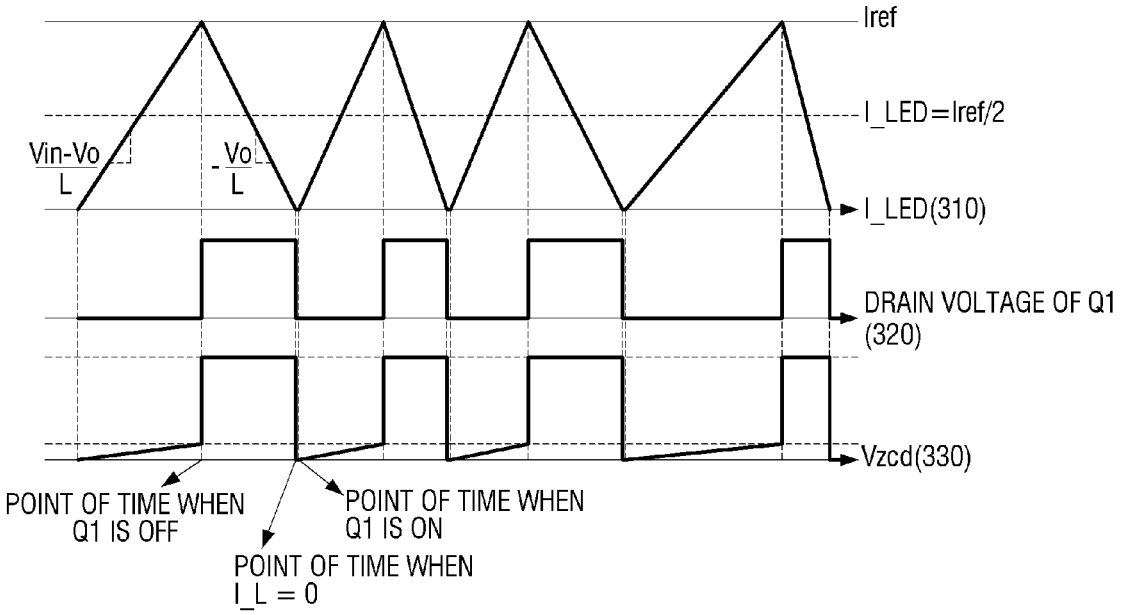
FIGS. 6A and 6B are graphs illustrating a LED output electric current, drain voltage of a transistor, and voltage applied to a third resistance according to an exemplary embodiment.
Figure 6B:
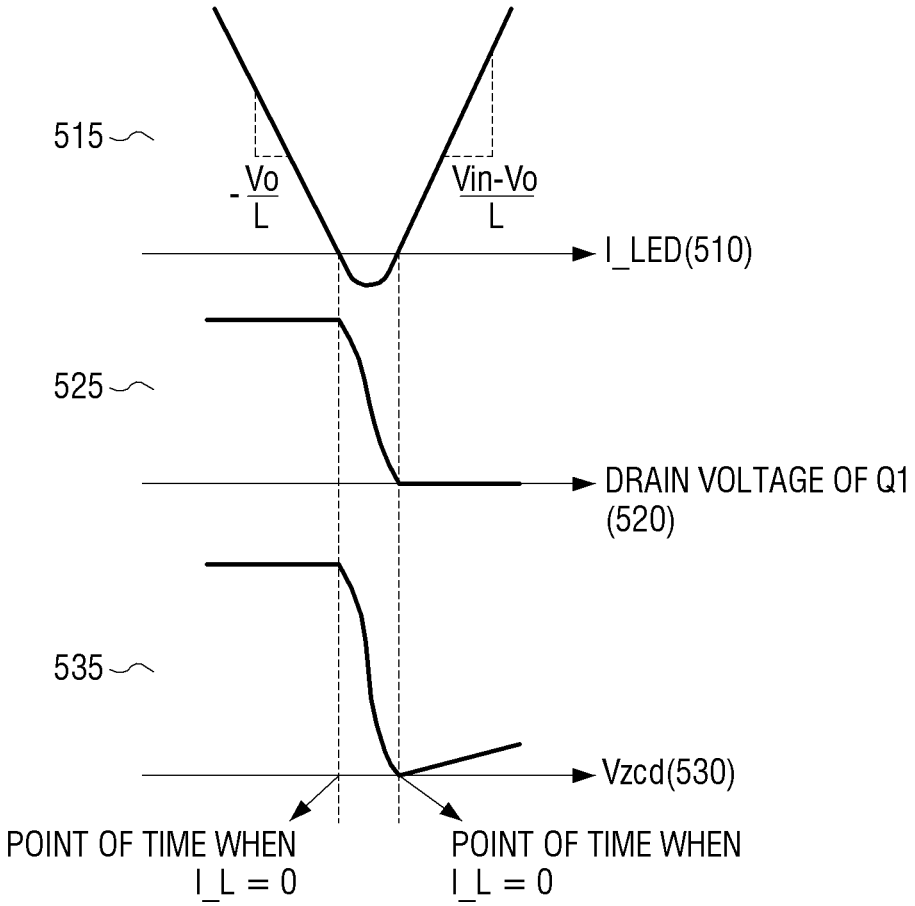

FIGS. 6A and 6B are graphs to explain LED output electric current, drain voltage of a transistor, and voltage applied to a third resistance according to an exemplary embodiment. Meanwhile, the LED driving apparatus 400 illustrated in FIG. 4 is also referred to in explaining FIGS. 5A and 5B.

Referring to FIG. 6A, it can be seen that LED output current increases at the moment that the LED output current becomes 0[A] although the gradient of the LED output current 510 is different in four wave forms.

That is, the LED output current (I_LED, 510) has the gradient of $(V_i-V_o)/L$ during on-time of a transistor and increases gradually. If it reaches the second reference value (Iref) and the transistor is turned off, the LED output current (I_LED, 510) has the gradient of $-(V_o)/L$ and decreases gradually. However, if external driving voltage ($V_i$), output voltage ($V_o$) or inductance (L) of an inductor changes due to external factors, the gradient of the LED output current 510 may change as illustrated in four wave forms in FIG. 5A.

However, as illustrated in FIG. 6A, the LED driving apparatus according to an exemplary embodiment turns on a transistor, not regularly, but when the LED output current becomes 0[A]. Therefore, constant current (I_LED=Iref/2) may flow through the LED module regardless of input/output voltage and characteristics of parts of the apparatus.

Meanwhile, if the decreasing LED output current reaches '0', a resonance circuit is formed in the first diode and between the parasitic capacitor of the transistor 426 and the inductor 425. Accordingly, the drain voltage of the transistor 426 (voltage of one end of the inductor 425) and voltage ($V_{zcd}$) applied to the third resistance 444 decreases in the form of a sine wave, which has already been described above with reference to FIG. 4.

That is, referring to FIG. 6B which explodes a point of time when the decreasing LED output current 510 with the gradient of $-(V_o)/L$ increases gradually with the gradient of $(V_i-V_o)/L$, if the LED output current 510 decreases gradually with the gradient of $-(V_o)/L$ and reaches 0[A], a section where the current flows in a reverse direction due to a resonance circuit formed in the first diode 424 and between the parasite capacitor of the transistor 426 and the inductor 425 is formed.

Meanwhile, during the section whether the LED output current 510 flows in a reverse direction from the time when it becomes 0[A], the drain voltage 520 of the transistor 426 (that is, voltage of one end of the inductor 425) and voltage ($V_{zcd}$) 530 applied to the third resistance 444 decreases in the form of sine wave.

Subsequently, at a time when the section where the LED output current 510 flows in a reverse direction is ended, the drain voltage 520 of the transistor 426 and the voltage ($V_{zcd}$) applied to the third resistance 444 become 0[V].

Meanwhile, the LED driving apparatus determines whether the voltage ($V_{zcd}$) applied to the third resistance 444 becomes 0[V]. If the voltage ($V_{zcd}$) applied to the third resistance 444 becomes 0[V], the transistor 426 is turned on to provide an external driving voltage to the LED module 410. Accordingly, a constant current having Iref/2 may always be provided to the LED module 410.

Figure 7:
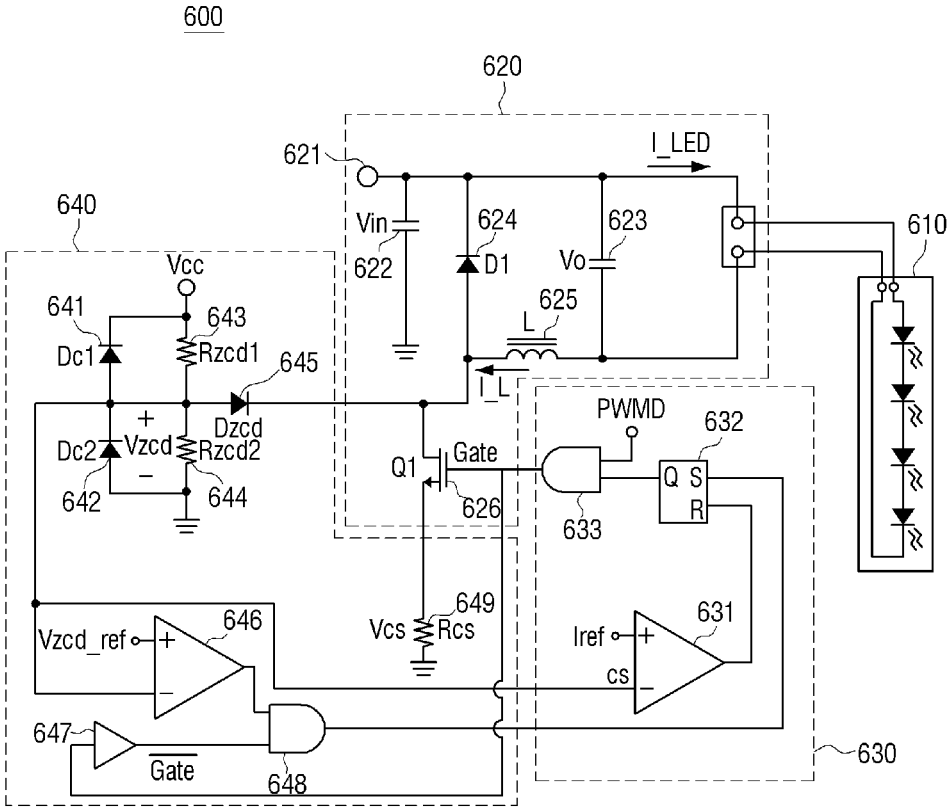
FIG. 7 is a circuit diagram illustrating a LED driving control unit according to another exemplary embodiment.

FIG. 7 is a circuit diagram to explain a LED driving control unit according to another exemplary embodiment. Each component of the LED driving apparatus 600 illustrated in FIG. 7 performs the same functions as each component of the LED driving apparatus 400 illustrated in FIG. 4. Therefore, further description will not be provided.

However, the LED driving apparatus 600 in FIG. 7 is distinct from the LED driving apparatus 400 in FIG. 4 in that, in the LED driving apparatus 600 in FIG. 7, the second comparator 631 instead of the first resistance 626 determines whether current of the LED module 610 reaches a predetermined volume using a voltage applied to the third resistance 644.

That is, the switching control unit 630 determines whether current of the LED module 610 reaches a predetermined volume using a voltage applied to the third resistance 644, and if the current of the LED module 610 reaches the predetermined volume, the switching control unit 630 may turn off the transistor 626.

Specifically, the switching control unit 630 may include the second comparator 631 comparing voltage applied to the third resistance 644 with a predetermined voltage, the RS flip flop 632 receiving the comparison result of the second comparator 631 as a reset signal and receiving the control signal of the sensing unit 640 as a set signal, and the second AND gate 633 outputting a logic product of the output signal of the RS flip flop 632 and a dimming signal to the gate of the transistor 626.

As such, if a circuit is configured as described above, the functions of the LED driving apparatus illustrated in FIG. 4 can be performed and at the same time, the number of external pins can be reduced when IC is realized.

Figure 8:
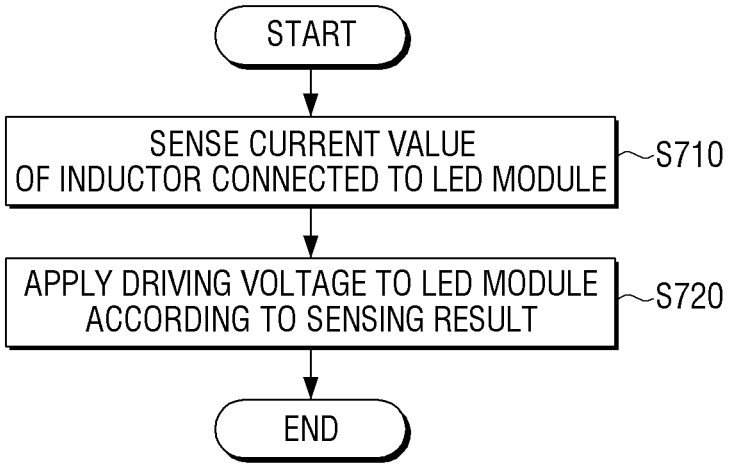
FIG. 8 is a flow chart illustrating a LED driving method to control a LED module according to an exemplary embodiment.

FIG. 8 is a flowchart to explain a LED driving method to control a LED module according to an exemplary embodiment.

First of all, a value of current of an inductor connected to a LED module is sensed (operation S710). Specifically, it is sensed whether current of the inductor is the first reference value or the second reference value. Herein, the second reference value may be greater than the first reference value.

According to the sensing result, driving voltage is applied to the LED module (operation S720). Specifically, driving voltage may be applied to the LED module using an external power source or an inductor excited by an external power source.

That is, a driving voltage may be applied to the LED module by exciting an inductor using current input from an external power source or by using current inducted by an excited inductor.

More specifically, an inductor is connected to a transistor, and according to the sensing result, the transistor is turned on or off. If current of the inductor is the first reference value, the transistor is turned on so that a driving voltage is applied to the LED module while exciting the inductor using current input from an external power source. If current of the inductor is the second reference value, the transistor is turned off so that a driving voltage is applied to the LED module using current induced by the excited inductor.

The term "unit", as used herein, means, but is not limited to, a software or hardware component.

Although a few exemplary embodiments have been shown and described, it would be appreciated by those skilled in the art that changes may be made in this exemplary embodiment without departing from the principles and spirit of the application, the scope of which is defined in the claims and their equivalents.

What is claimed is:

1. A display apparatus comprising:

a display panel which displays an image;

a light emitting diode (LED) module, which provides backlight to the display panel;

a LED driving unit, which selectively uses current of an inductor to apply a driving voltage to the LED module;

a sensing unit which senses a current value of the inductor; and a switching control unit which applies the driving voltage according to a sensing result of the sensing unit, wherein the LED driving unit includes a transistor connected to the inductor, wherein the sensing unit includes a first comparator which compares the current value of the inductor with a predetermined first reference value and a first AND gate which performs a logic product of an inversion gate signal regarding a gate signal applied to a gate of the transistor and a comparison result of the first comparator and outputs a result of the logic product.

2. The apparatus as claimed in claim 1, wherein the LED driving unit applies the driving voltage to the LED module while exciting the inductor using a current input from an external power source or the LED driving unit applies driving voltage to the LED module using current induced by the excited inductor.

3. The apparatus as claimed in claim 2, wherein the switching control unit turns on or off the transistor according to the sensing result by the sensing unit, applies the driving voltage to the LED module while exciting the inductor using the current input from the external power source when the transistor is turned on, and applies the driving voltage to the LED module using the current induced by the excited inductor when the transistor is turned off.

4. The apparatus as claimed in claim 3, wherein the switching control unit turns on the transistor when the current value sensed by the sensing unit is the predetermined first reference value, and turns off the transistor when the current value sensed by the sensing unit is a predetermined second reference value, wherein the predetermined second reference value is greater than the predetermined first reference value.

5. The apparatus as claimed in claim 3, wherein the LED driving unit comprises:

an input terminal which receives the external power source;

a first capacitor which connects the input terminal to ground;

a first diode which connects a first end of the inductor to the input terminal; and a second capacitor which connects a second end of the inductor to the input terminal, wherein the LED module is connected to the second capacitor in parallel, and wherein a connection node between the inductor and the diode is connected to a first end of the transistor.

6. The apparatus of claim 2, wherein the LED driving unit comprises an input terminal which receives an input voltage, a first diode which connects a first end of the inductor to the input terminal, and a capacitor which connects a second end of the inductor to the input terminal.

7. The apparatus of claim 2, wherein the switching control unit turns on the transistor when the current value sensed by the sensing unit is the predetermined first reference value and turns off the transistor when the current value sensed by the sensing unit is a predetermined second reference value.

8. A light emitting diode (LED) driving apparatus which controls a LED module, the apparatus comprising:

a LED driving unit which selectively uses current of an inductor to apply a driving voltage to the LED module;

a sensing unit which senses a current value of the inductor; and a switching control unit which adjusts the driving voltage according to a sensing result of the sensing unit, wherein the LED driving unit includes a transistor connected to the inductor, wherein the sensing unit comprises:

a first comparator which compares the current value of the inductor with a predetermined first reference value; and a first AND gate which performs a logic product of an inversion signal regarding a gate signal applied to a gate of the transistor and a comparison result of the first comparator and outputs a result of the logic product.

9. The apparatus as claimed in claim 8, wherein the LED driving unit applies the driving voltage to the LED module while exciting the inductor using current input from an external power source or the LED driving unit applies driving voltage to the LED module using current induced by the excited inductor.

10. The apparatus as claimed in claim 9, wherein the switching control unit turns on or off the transistor according to the sensing result by the sensing unit, applies the driving voltage to the LED module while exciting the inductor using current input from the external power source if the transistor is turned on, and applies the driving voltage to the LED module using current induced by the excited inductor if the transistor is turned off.

11. The apparatus as claimed in claim 10, wherein the switching control unit turns on the transistor when the current value sensed by the sensing unit is a the predetermined first reference value and turns off the transistor when the current value sensed by the sensing unit is a predetermined second reference value, wherein the second predetermined reference value is greater that the predetermined first reference value.

12. The apparatus as claimed in claim 10, wherein the LED driving unit comprises:

an input terminal which receives the input voltage;

a first diode which connects a first end of the inductor to the input terminal; and a capacitor which connects a second end of the inductor to the input terminal, wherein the LED module is connected to the capacitor in parallel;

wherein a connection node between the inductor and the diode is connected to a first end of the transistor.

13. A LED driving method to control a LED module, the method comprising:

sensing a value of a current of an inductor connected to the LED module; and applying a driving voltage to the LED module using an external power source or the inductor excited by the external power source according to a result of the sensing, wherein the inductor is connected to a transistor; and wherein the sensing the value of the current of the inductor comprises comparing the current value of the inductor with a predetermined first reference value using a first comparator, performing a logic product of an inversion gate signal regarding a gate signal applied to a gate of the transistor connected to the inductor and a comparison result of the first comparator using a first AND gate and outputs a result of the logic product.

14. The method as claimed in claim 13, wherein the applying the driving voltage to the LED module comprises applying the driving voltage to the LED module while exciting the inductor using current input from the external power source or applying driving voltage to the LED module using current induced by the excited inductor.

15. The method as claimed in claim 13, wherein the sensing comprises sensing whether the current value of the inductor is the predetermined first reference value or a second reference value, wherein the second reference value is greater than the first reference value.

16. The method as claimed in claim 15, wherein the applying driving voltage to the LED module comprises:

turning on or turning off the transistor according to the result of the sensing by the sensing unit, applying the driving voltage to the LED module by turning on the transistor while exciting the inductor using current input from an external power source when the current value of the inductor is the predetermined first reference value, and applying the driving voltage to the LED module by turning off the transistor using current induced by the excited inductor when the current value of the inductor is the second reference value.

* * * * *